US007462302B2

(12) United States Patent
Chang et al.

(10) Patent No.: US 7,462,302 B2
(45) Date of Patent: Dec. 9, 2008

(54) INDIUM OXIDE BASED MATERIAL AND METHOD FOR PREPARING THE SAME

(75) Inventors: Chung-Cheng Chang, 10, 10 alley, 251 lane, Hsin Feng Street, Keelun (TW); Shin-Bin Huang, Hu Kou town (TW)

(73) Assignee: Chung-Cheng Chang (TW)

( * ) Notice: Subject to any disclaimer, the term of this patent is extended or adjusted under 35 U.S.C. 154(b) by 297 days.

(21) Appl. No.: 11/336,142

(22) Filed: Jan. 20, 2006

(65) Prior Publication Data

US 2007/0170400 A1 Jul. 26, 2007

(51) Int. Cl.
*H01B 1/08* (2006.01)

(52) U.S. Cl. ..... 252/506; 252/520.1

(58) Field of Classification Search ..... 252/506, 252/519.51, 520.1; 423/624; 427/335, 377
See application file for complete search history.

(56) References Cited

U.S. PATENT DOCUMENTS 4,937,148 A * 6/1990 Sato et al. ..... 423/618

FOREIGN PATENT DOCUMENTS

GB 2192644 * 1/1988
JP 05024837 * 2/1993
JP 2004014439 * 1/2004

OTHER PUBLICATIONS

Hanamoto et al "Effects of carbon implantation on the electrical properties of amorphous In2O3 thin films", Nuclear Instruments and Methods in Physics Research B 184 (2001) 371-377.*

* cited by examiner

*Primary Examiner*—Mark Kopec
(74) *Attorney, Agent, or Firm*—Ostrolenk, Faber, Gerb & Soffen, LLP

(57) ABSTRACT

An indium oxide based material containing carbon, and a method for preparing the same are provided. In such a method, the carbon is added to the indium oxide based material film so that the electrical resistivity of the indium oxide based material film is decreased, and the light transmittance of the indium oxide based material in the shorter wavelength range is increased, and also the light can transmit through such a material over a broader short wavelength range. The indium oxide based material prepared by the method of the present invention has higher electrical conductivity and higher light transmittance in comparison with the conventional one without adding carbon.

3 Claims, 7 Drawing Sheets

INDIUM OXIDE BASED MATERIAL AND METHOD FOR PREPARING THE SAME

BACKGROUND OF THE INVENTION

1. Field of the Invention

The present invention generally relates to an indium oxide or an indium oxide based material, and a method for preparing the same, which is capable of increasing the electrical conductivity and light transmittance of the indium oxide or indium oxide based material, and in particular to an indium oxide or an indium oxide based material, and a method for preparing the indium oxide or the indium oxide based material by adding a carbon-containing compound thereto in order to increase its electrical conductivity and light transmittance.

2. The Prior Arts

The conventional indium oxide ($In_2O_3$) and the conventional indium oxide based material, such as indium tin oxide (ITO) and indium zinc oxide, are known to have high transparency and high electrical conductivity, and they are often used as a material for manufacturing the electrodes of the optoelectronic devices, such as the thin film transistor liquid crystal display (TFT-LCD), organic light emitting diodes (OLED), light emitting diodes (LED), and liquid crystal screens or touch screens of the electronic devices. Due to the rapid development of the flat panel displays (FPD), the improvement of the transparency and electrical conductivity of the conductive film made of indium tin oxide or its related materials is becoming a major topic of research in industry.

Typically, the indium oxides and the indium oxide based materials are prepared by solid-state reaction, chemical reaction, sol-gel method, physical vapour deposition, liquid phase deposition, and the like. In order to reduce the electrical resistivity and to increase the light transparency, the elements other than carbon are added to the indium oxides or the indium oxide based materials, or alternatively the indium oxide or indium oxide based materials are annealed in $N_2$, $O_2$, or $H_2$ in a conventional method. In addition, indium oxides and the indium oxide based materials which are reduced electrical resistivity and increased light transparency are used to be made into the thin film electrodes. The method for forming an electrode thin film includes physical vapour deposition, physical vapour deposition, or sol-gel method. The method for adding the elements to the indium oxides and the indium oxide based materials includes solid-state reaction, chemical reaction, alloyed method, or doping method (such as diffusion, and ion implantation).

Using indium tin oxide as an example, the indium oxide ($In_2O_3$)/tin oxide ($SnO_2$) powder is subjected to compounding, hot pressing, sintering, annealing, and other treatments to produce a sputtering target, and then the indium tin oxide film is formed on a substrate by sputtering using this sputtering target. In order to decrease the resistivity of the indium tin oxide film, the indium tin oxide film is subjected to annealing under the flow of nitrogen. However, the decreased resistivity is still not enough for practice use.

SUMMARY OF THE INVENTION

The objective of the present invention is to provide a method for preparing an indium oxide or an indium oxide based material, which is capable of increasing electrical conductivity and light transmittance of the indium oxide or indium oxide based material. Another objective of the present invention is to provide an indium oxide or an indium oxide based material which has increased electrical conductivity and light transmittance.

The method for preparing an indium oxide based material, such as indium oxide, indium tin oxide, or indium zinc oxide, which has increased electrical conductivity and light transmittance is provided. This method is characterized in that the carbon is added to an indium oxide or an indium oxide based material. The indium oxide or the indium oxide based material prepared by the method of the present invention has higher electrical conductivity and higher light transmittance than the conventional one without adding carbon. Increasing the light transmittance of the indium oxide based material means that the light transmittance of the indium oxide based material in the shorter wavelength range is increased, and also the transmittable shorter wavelength range for the material is increased. The shorter wavelengths means that these transmittable wavelengths are shorter than the other transmittable wavelengths, and is typically less than 500 nm, and particularly 300-500 nm.

In the method of the present invention, the carbon is added to the indium oxide or the indium oxide based material during its fabrication processes in order to increase the electrical conductivity and the light transmittance thereof. Any suitable conventional method for adding or doping carbon into the indium oxide or the indium oxide based material can be used in the present invention. Examples of the conventional method for adding or doping carbon include, but not limited to, ion implantation, gaseous diffusion process, liquid-liquid diffusion, solid state diffusion, alloyage, chemical reaction, physical vapour deposition, and chemical vapour deposition. Examples of the carbon sources include, carbon materials, carbon-containing materials, carbon compounds, and hydrocarbon compounds. Examples of the carbon materials include, but not limited to, graphite and diamond. Examples of the carbon-containing materials include, but not limited to, coal. Examples of the carbon compounds include, but not limited to, calcium carbonate and sodium bicarbonate. Examples of the hydrocarbon compounds include, but not limited to, alkane, alkyne, alcohols, and ketones.

The carbon-containing indium oxide or indium oxide based material of the present invention has higher electrical conductivity than that of the indium oxide or indium oxide based material without carbon. Furthermore, in comparison with the conventional indium oxide or indium oxide based material film, the carbon-containing indium oxide or the indium oxide based material film of the present invention has higher light transmittance in the shorter wavelength range, and it also can transmit light over a broader short wavelength range.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENT

The method for preparing an indium oxide based material of the present invention includes, but not limited to, the step of adding the carbon to the indium oxide based material, or alternatively doping the carbon into the indium oxide based material in order to prepare a carbon-containing indium oxide based material.

Figure 1:
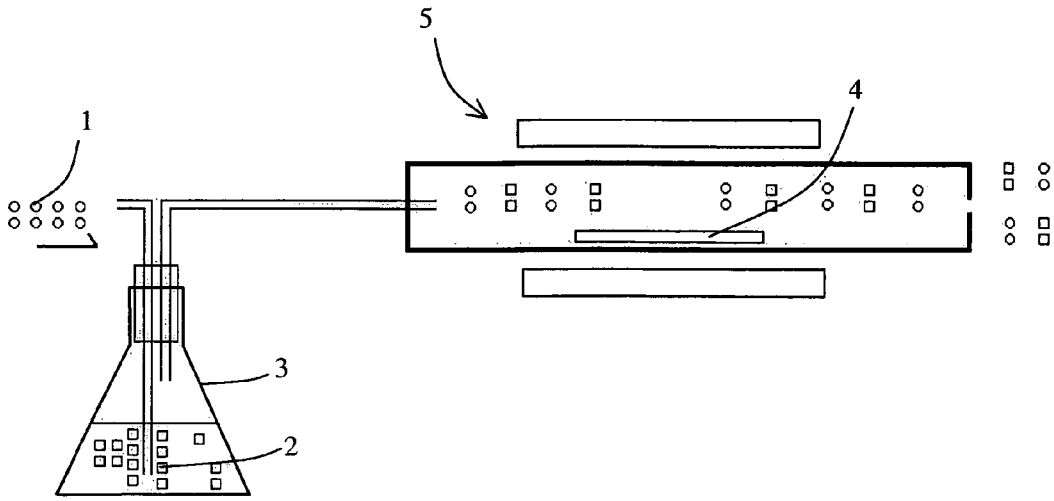
FIG. 1 is a schematic view of a device in which a hydrocarbon compound is added to a sample in an annealing system according to one embodiment of the present invention.

According to one embodiment of the present invention, the carbon is added to the indium oxide based material during annealing. Referring to FIG. 1, a hydrocarbon compound used as a carbon source is added to the indium oxide based material. In such a method, the indium tin oxide film is formed on a substrate, such as glass or silicon, by sputtering, and then the annealing process is carried out under the controlled flow of nitrogen gas 1, and when bubbling nitrogen 1 through the organic solvent 2 with a boiling point less than 100° C., such as methanol, ethanol or acetone, contained in a container 3, the volatile organic solution 2 will mix with the nitrogen 1.

Subsequently, a gas mixture of organic solvent vapor in nitrogen formed during bubbling is introduced to an annealing system 5 in which the indium tin oxide sample 4 has been disposed, and therefore the carbon present in the organic solvent is introduced into the indium tin oxide. The annealing temperature is preferably at 250-300° C., although it depends upon the kinds of the indium oxide based materials. The annealing time is preferably 30-60 minutes for the indium tin oxide.

If the carbon-containing indium oxide or indium oxide based material is prepared by the method of the present invention, its resistivity will be decreased and also its light transmittance will be increased, particularly in the shorter wavelength range of 300-500 nm.

Although the carbon is introduced into the indium oxide or indium oxide based material by the above-mentioned diffusion method, the person skilled in the art would realize that there may be other methods suitably used for carbon introduction, such as ion implantation, gaseous diffusion process, liquid diffusion, solid state diffusion, alloyage, chemical reaction, physical vapour deposition, or chemical vapour deposition. All the above-mentioned methods are known to a person skilled in the art, so the carbon introduction can be easily carried out by such methods.

EXAMPLE 1

The nitrogen gas and the oxygen gas are respectively introduced to the annealing system as shown in FIG. 1, and the nitrogen gas is also introduced to the container containing ethanol or ammonia water, and then a gas mixture of ethanol vapor or ammonia water vapor, and nitrogen gas is obtained by bubbling nitrogen gas through the container. The gas mixture is then introduced to the annealing system in which the indium tin oxide film sputtered at 25° C. has been disposed. Subsequently, the annealing process is carried out at 300° C. for one hour. The light transmittances of the indium tin oxide films without annealing and with annealing in different gases are respectively measured by a UV/VIS/NIR spectrometer, as shown in FIG. 2.

Figure 2:
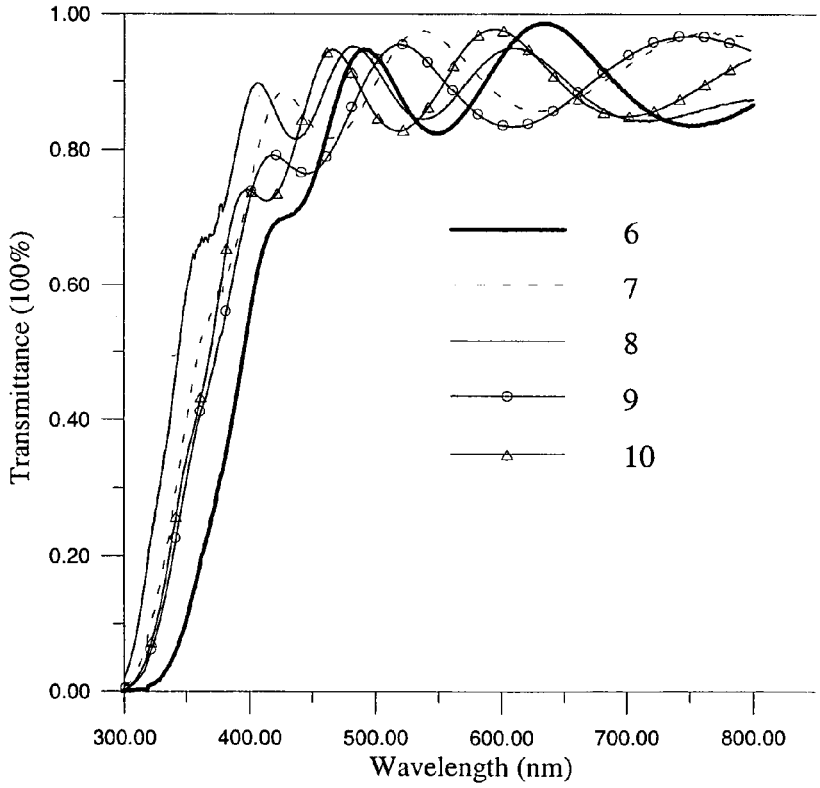
FIG. 2 is the transmittance curves of the indium tin oxide films formed by sputtering at 25° C. as-deposited and annealed at 300° C. for one hour in different gas environments.
Figure 3:
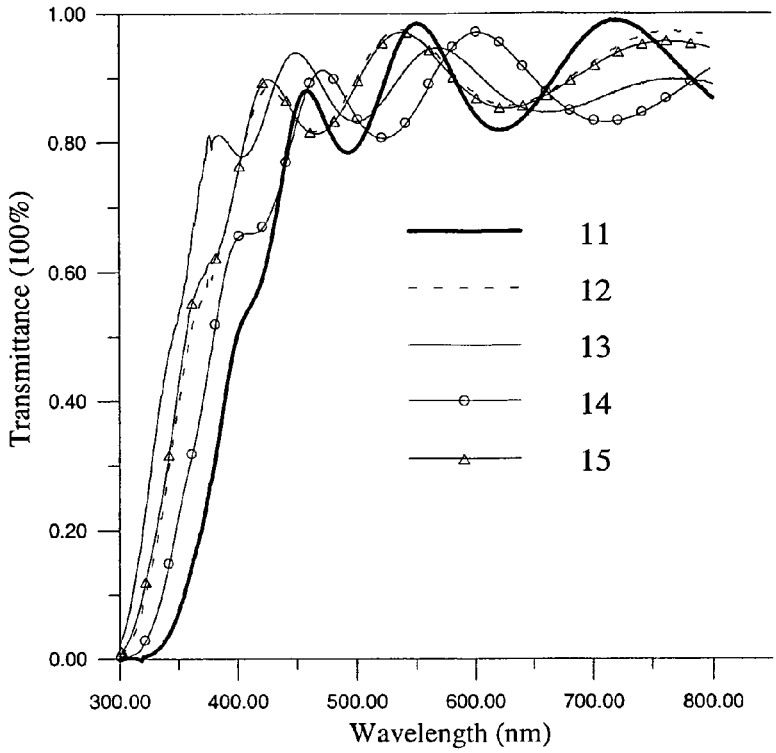
FIG. 3 is the transmittance curves of the indium tin oxide films formed by sputtering at 100° C. as-deposited and annealed at 300° C. for one hour in different gas environments.
Figure 4:
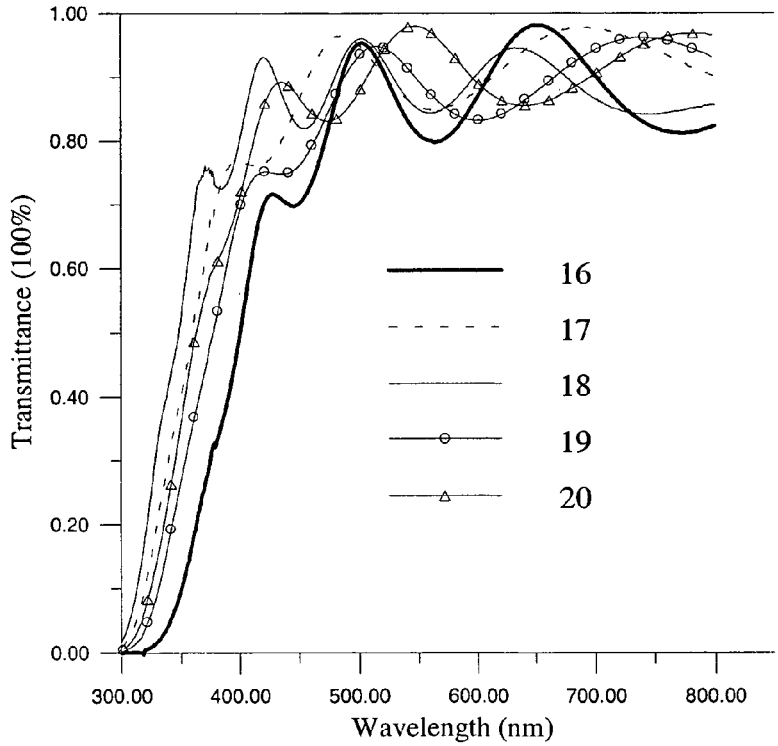
FIG. 4 is the transmittance curves of the indium tin oxide films formed by sputtering at 200° C. as-deposited and annealed at 300° C. for one hour in different gas environments.
Figure 5:
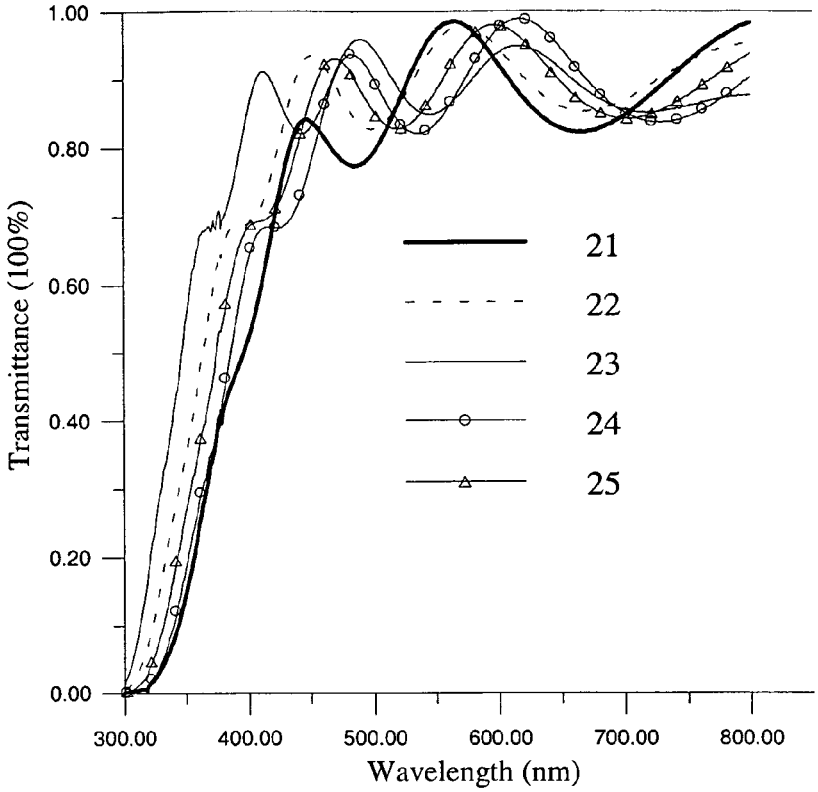
FIG. 5 is the transmittance curves of the indium tin oxide films formed by sputtering at 250° C. as-deposited and annealed at 300° C. for one hour in different gas environments.
Figure 6:
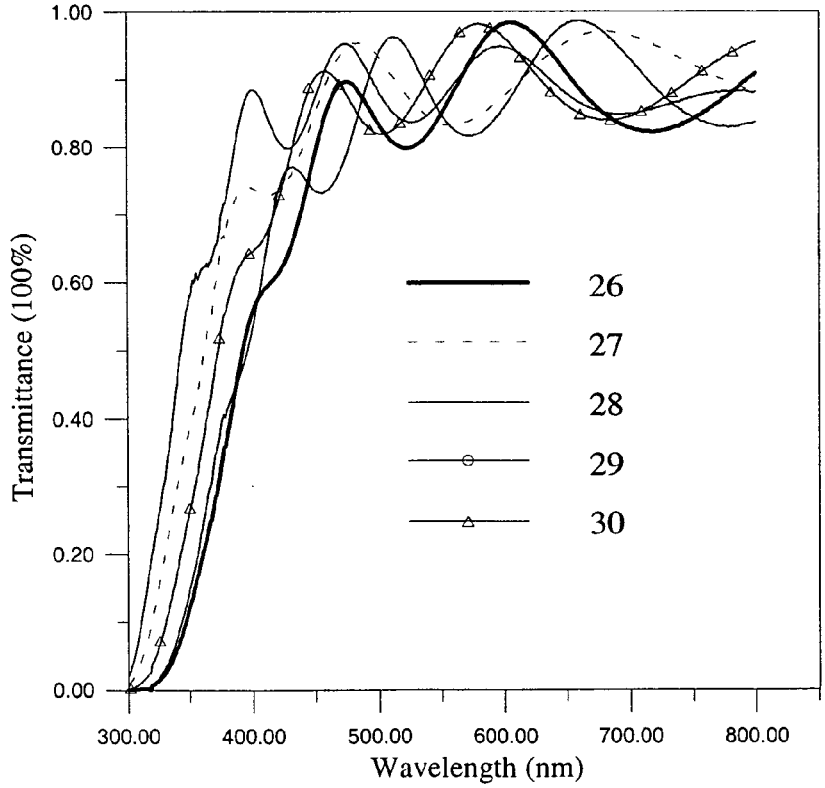
FIG. 6 is the transmittance curves of the indium tin oxide films formed by sputtering at 300° C. as-deposited and annealed at 300° C. for one hour in different gas environments.

Referring to FIG. 2, the transmittance edge of the indium tin oxide film annealed under the flow of the gas mixture of ethanol vapor in nitrogen shifts toward the shorter wavelength side (blue shift) in comparison with the indium tin oxide film without annealing 6. That is, the annealed indium tin oxide film has higher light transmittance over the spectrum range of 300-500 nm. The transmittance edge of the annealed indium tin oxide film shifts toward the shorter wavelength side in comparison with the unannealed indium tin oxide film. The transmittance edges of the annealed indium tin oxide films are blue shifted in the following order: when annealed under the flow of the gas mixture of ethanol vapor in nitrogen 8> when annealed under the flow of the pure nitrogen gas 7> when annealed under the flow of the gas mixture of ammonia water vapor in nitrogen 10> when annealed under the flow of the pure oxygen gas 9. In FIG. 2, the reference numeral 6 represents without annealing; the reference numeral 7 represents the introduction of pure nitrogen to the annealing system; the reference numeral 8 represents the introduction of ethanol in nitrogen to the annealing system; the reference numeral 9 represents the introduction of pure oxygen to the annealing system; and the reference numeral 10 represents the introduction of ammonia water in nitrogen to the annealing system.

EXAMPLE 2

The same measurement method and conditions as in Example 1 are used except that the indium tin oxide films are respectively formed on a substrate by sputtering at 100° C., 200° C., 250° C., and 300° C. instead of 25° C. The light transmittances of the indium tin oxide films treated under the same conditions as in Example 1 are respectively measured by a UV/VIS/NIR spectrometer. These measured light transmittances are respectively shown in FIG. 3, FIG. 4, FIG. 5, and FIG. 6. In FIG. 3, FIG. 4, FIG. 5, and FIG. 6, the reference numerals 11, 16, 21, 26 represent without annealing; the reference numerals 12, 17, 22, 27 represent the introduction of pure nitrogen to the annealing system; the reference numerals 13, 18, 23, 28 represent the introduction of ethanol in nitrogen to the annealing system; the reference numerals 14, 19, 24, 29 represent the introduction of pure oxygen to the annealing system; and the reference numerals 15, 20, 25, 30 represent the introduction of ammonia water in nitrogen to the annealing system.

As seen from FIGS. 3, 4, 5 and 6, the same measured results for different treated indium tin oxide films as in Example 1 are obtained. That is, the transmittance edge of the indium tin oxide film annealed under the flow of the gas mixture of ethanol vapor in nitrogen shifts to the shortest wavelength in comparison with the other indium tin oxide films unannealed, or annealed in different atmospheres. In other words, the indium tin oxide film annealed under the flow of the gas mixture of ethanol vapor in nitrogen has the highest light transmittance in the wavelength range of 300-500 nm in comparison with the other treated indium tin oxide films.

Therefore, if the carbon is added to the indium tin oxide film during annealing, the light transmittance of the indium tin oxide in the shorter wavelength range will be increased, and also the light can be transmitted through the indium tin oxide over a broader short wavelength range.

EXAMPLE 3

Figure 7:
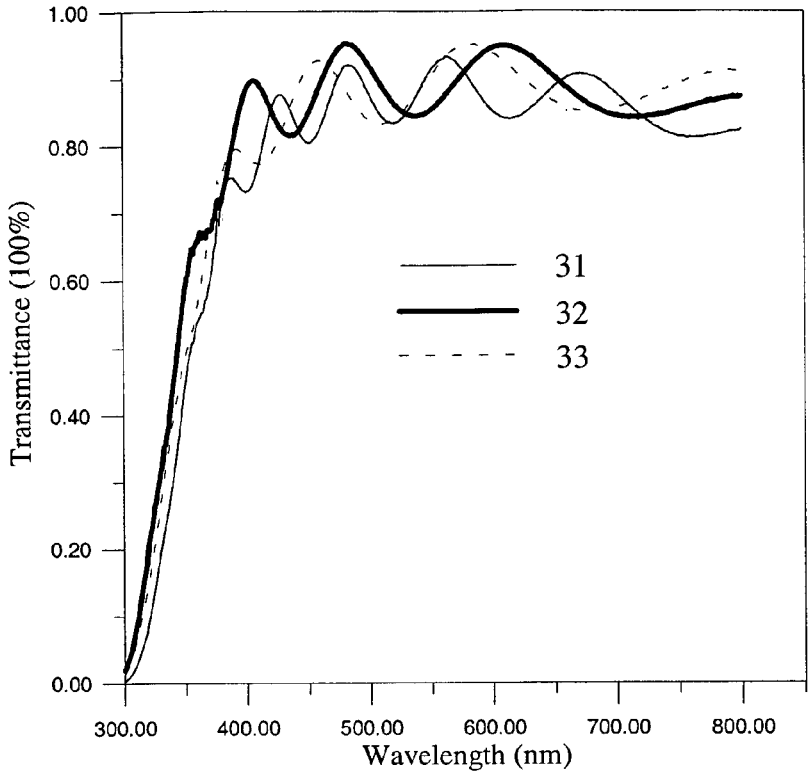
FIG. 7 is the transmittance curves of the indium tin oxide films formed by sputtering at 25° C. as-deposited and annealed at 300° C. for one hour in different carbon-containing gas environments.
Figure 8:
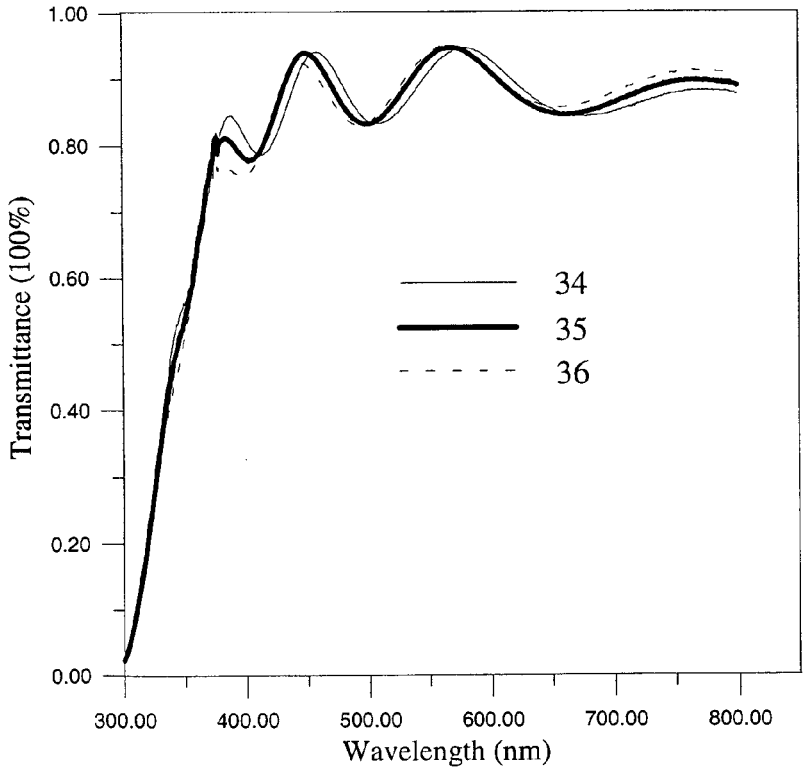
FIG. 8 is the transmittance curves of the indium tin oxide films formed by sputtering at 100° C. as-deposited and annealed at 300° C. for one hour in different carbon-containing gas environments.
Figure 9:
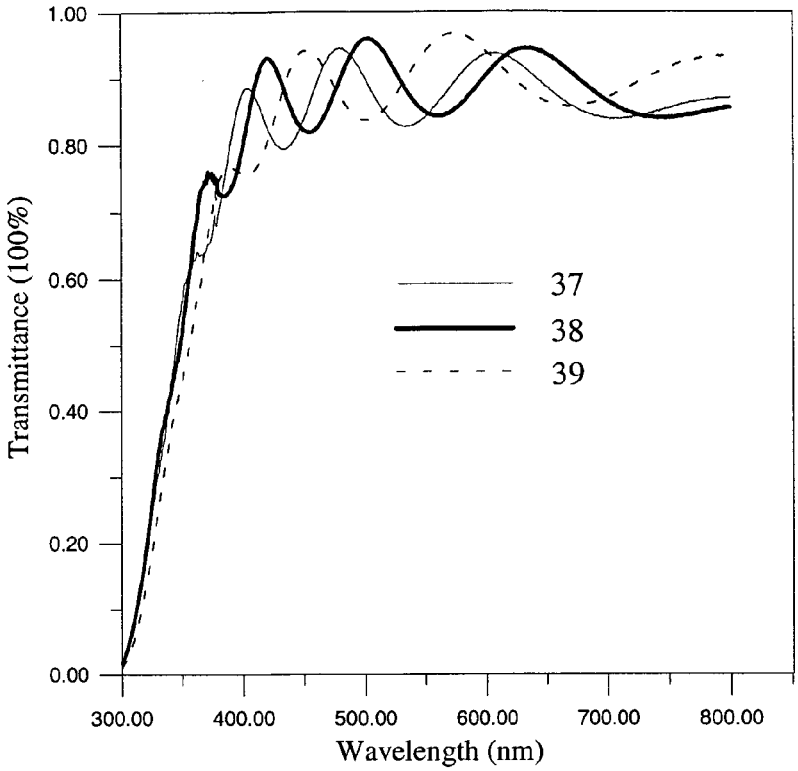
FIG. 9 is the transmittance curves of the indium tin oxide films formed by sputtering at 200° C. as-deposited and annealed at 300° C. for one hour in different carbon-containing gas environments.
Figure 10:
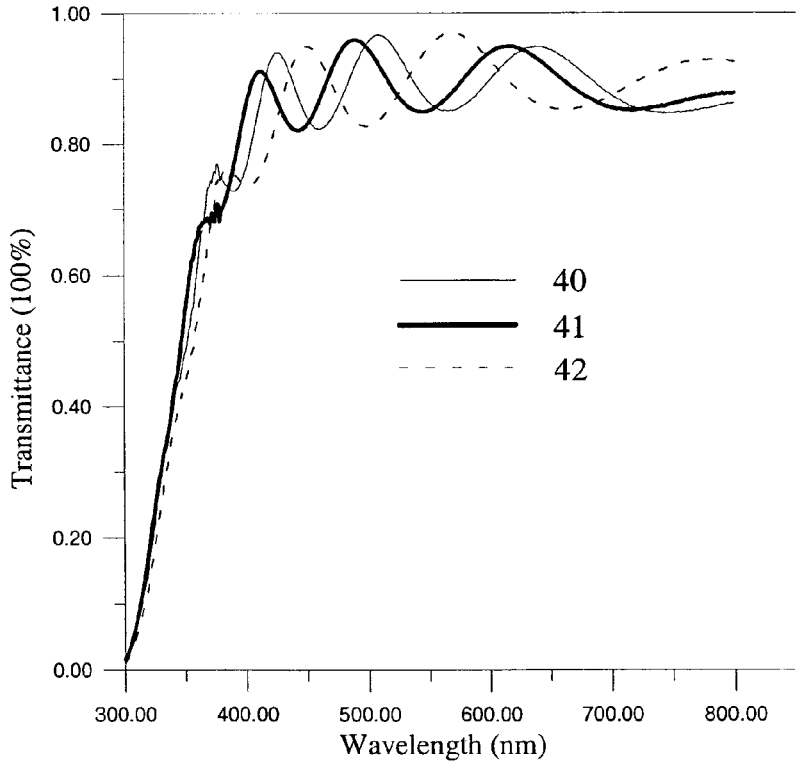
FIG. 10 is the transmittance curves of the indium tin oxide films formed by sputtering at 250° C. as-deposited and annealed at 300° C. for one hour in different carbon-containing gas environments.
Figure 11:
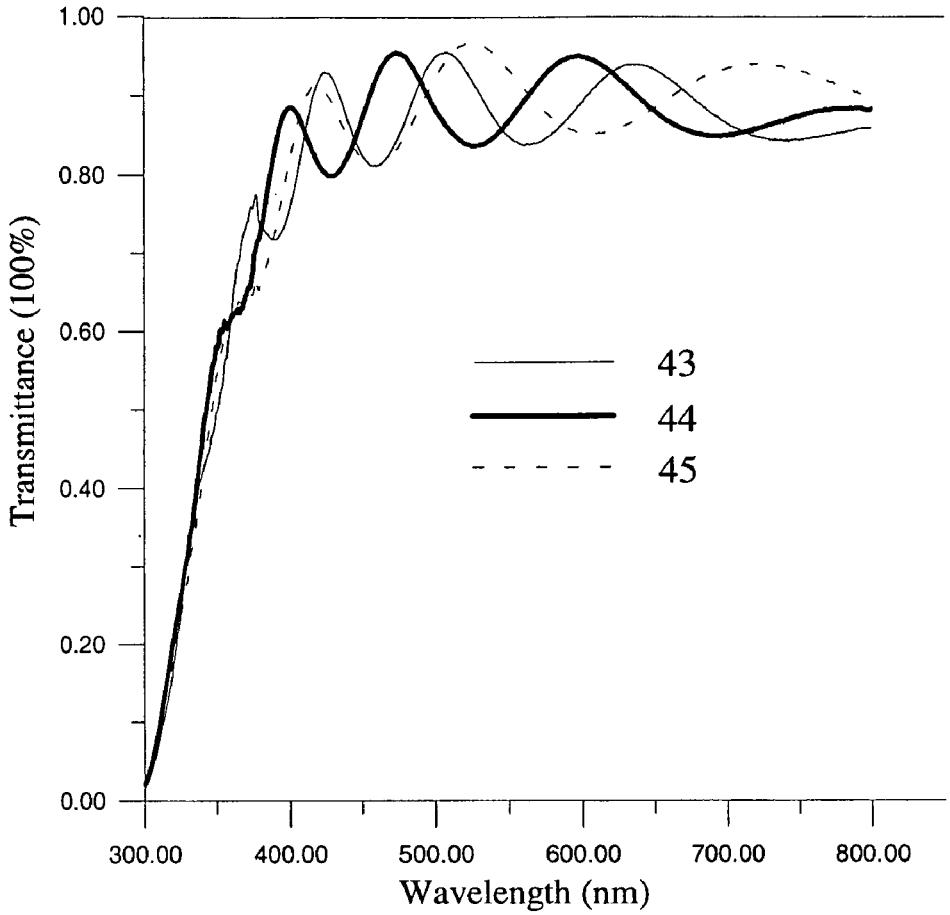
FIG. 11 is the transmittance curves of the indium tin oxide films formed by sputtering at 300° C. as-deposited and annealed at 300° C. for one hour in different carbon-containing gas environments.

The same measurement method and conditions as in Example 1 are used except that methanol, ethanol, or acetone is placed in a container. The light transmittances of the indium tin oxide films treated under the same conditions as in Example 1 are respectively measured by a UV/VIS/NIR spectrometer. These measured light transmittances for the indium tin oxide films annealed under the flow of methanol vapor in nitrogen, ethanol vapor in nitrogen, and acetone vapor in nitrogen are respectively shown in FIG. 7. In FIG. 7, the reference numeral 31 represents the introduction of methanol in nitrogen to the annealing system; the reference numeral 32 represents the introduction of ethanol in nitrogen to the annealing system; and the reference numeral 33 represents the introduction of acetone in nitrogen to the annealing system.

As seen from FIG. 7, the transmittance edges of the indium tin oxide films respectively annealed under the flow of the gas mixture of methanol vapor in nitrogen, ethanol vapor in nitrogen, and acetone vapor in nitrogen shift to the shorter wavelength side. However, no distinct difference in the transmittance edge shift for the indium tin oxide films respectively annealed under the flow of methanol vapor in nitrogen, ethanol vapor in nitrogen, and acetone vapor in nitrogen is observed.

EXAMPLE 4

The same measurement method and conditions as in Example 3 are used except that the indium tin oxide films are respectively formed on a substrate by sputtering at 100° C., 200° C., 250° C., and 300° C. instead of 25° C. The light transmittances of the indium tin oxide films treated under the same conditions as in Example 1 are respectively measured by a UV/VIS/NIR spectrometer. These measured light transmittances are respectively shown in FIGS. 8, 9, 10 and 11. In FIGS. 8, 9, 10 and 11, the reference numerals 34, 37, 40 and 43 represent the introduction of methanol in nitrogen to the annealing system; the reference numerals 35, 38, 41 and 44 represent the introduction of ethanol in nitrogen to the annealing system; and the reference numerals 36, 39, 42 and 45 represent the introduction of acetone in nitrogen to the annealing system.

As seen from FIGS. 8, 9, 10 and 11, the same measured results for different treated indium tin oxide films as in Example 3 are obtained. That is, the indium tin oxide films respectively annealed at 100° C., 200° C., 250° C., and 300° C. and under the flow of the gas mixture of methanol vapor in nitrogen, ethanol vapor in nitrogen, and acetone vapor in nitrogen, respectively, have similar light transmittance values.

Therefore, if the gas mixture of methanol vapor in nitrogen, ethanol vapor in nitrogen, or acetone vapor in nitrogen is introduced to the indium tin oxide film during annealing, the indium tin oxide film will have higher light transmittance in the shorter wavelength range, and also the light can transmit through it over a broader short wavelength range in comparison with the conventional indium tin oxide film without carbon.

EXAMPLE 5

Figure 12:
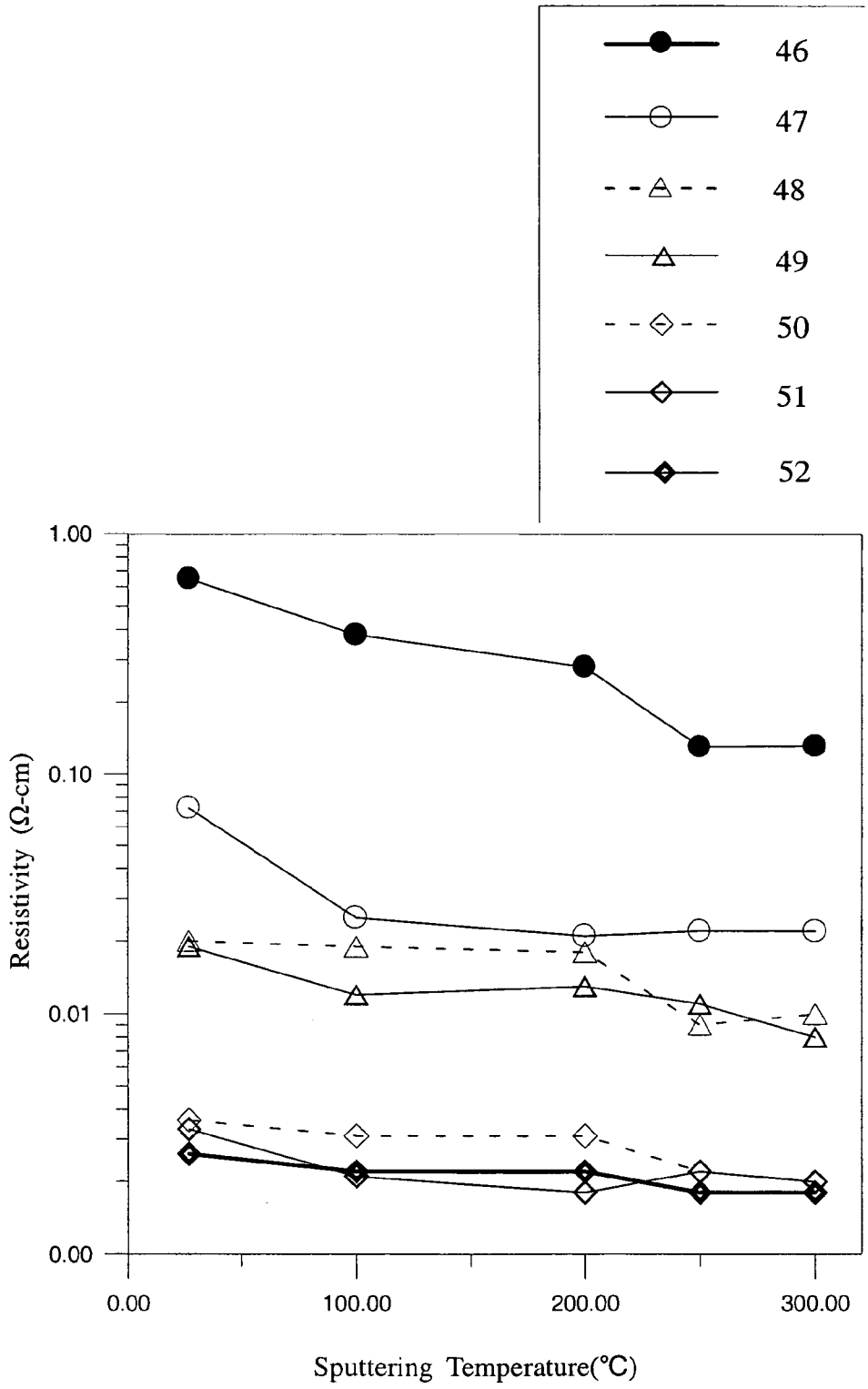
FIG. 12 is the electrical resistivity vs. the sputtering temperature plot for each indium tin oxide film annealed at 300° C. for one hour in different gas environments.

The same preparation method as in Examples 1 and 2 are used, and the indium tin oxide films respectively formed by sputtering at 25° C., 100° C., 200° C., 250° C., and 300° C. are annealed in an annealing system at 300° C. for one hour. The pure oxygen gas, the gas mixture of ammonia water vapor in nitrogen, the pure nitrogen gas, the gas mixture of methanol vapor in nitrogen, the gas mixture of ethanol vapor in nitrogen, and the gas mixture of acetone vapor in nitrogen are respectively introduced into the annealing system as shown in FIG. 1 disposed with the indium tin oxide film formed on a substrate by sputtering at 25° C., 100° C., 200° C., 250° C., and 300° C., respectively. FIG. 12 is the electrical resistivity vs. the sputtering temperature plot for each indium tin oxide film annealed at 300° C. for one hour in different gas environments. In FIG. 12, the reference numeral 46 represents without annealing; the reference numeral 47 represents the introduction of pure oxygen gas to the annealing system; the reference numeral 48 represents the introduction of the gas mixture of ammonia water vapor in nitrogen to the annealing system; the reference numeral 49 represents the introduction of the pure nitrogen gas to the annealing system; the reference numeral 50 represents the introduction of the gas mixture of acetone vapor in nitrogen to the annealing system; the reference numeral 51 represents the introduction of the gas mixture of ethanol vapor in nitrogen to the annealing system; and the reference numeral 52 represents the introduction of methanol vapor in nitrogen to the annealing system.

As seen from FIG. 12, the electrical resistivities for the indium tin oxide films treated with methanol vapor in nitrogen, ethanol vapor in nitrogen, or acetone vapor in nitrogen are decreased in comparison with the indium tin oxide film without annealing, or in comparison with the indium tin oxide film annealed only in nitrogen.

Using indium tin oxide formed on a substrate by sputtering at 25° C. as an example, the electrical resistivity of the indium tin oxide formed by sputtering at 25° C. is approximately $6500\times10^{-4}$ Ω-cm. This indium tin oxide formed by sputtering at 25° C. is annealed at 300° C. for one hour under the flow of nitrogen gas, and the electrical resistivity of the annealed indium tin oxide is measured, and the measured value is $190\times10^{-4}$ Ω-cm. The indium tin oxide, which is formed by sputtering at 25° C. and has the electrical resistivity of $6500\times10^{-4}$ Ω-cm, is annealed under the flow of methanol vapor in nitrogen, and the electrical resistivity of the annealed indium tin oxide is measured and found to be $26\times10^{-4}$ Ω-cm. In this case, the electrical resistivity of the indium tin oxide annealed under the flow of methanol vapor in nitrogen is at least 7 times as low as the electrical resistivity of the indium tin oxide annealed under the flow of nitrogen. The electrical resistivity of the indium tin oxide formed by sputtering at 300° C. is $1300\times10^{-4}$ Ω-cm, and this indium tin oxide is annealed at 300° C. for one hour under the flow of nitrogen, and the electrical resistivity of the annealed indium tin oxide is measured and found to be $80\times10^{-4}$ Ω-cm. The indium tin oxide, which is formed by sputtering at 300° C. and has the electrical resistivity of $1300\times10^{-4}$ Ω-cm, is annealed under the flow of methanol vapor in nitrogen, and the electrical resistivity of the annealed indium tin oxide is measured and found to be $18\times10^{-4}$ Ω-cm. In this case, the electrical resistivity of the indium tin oxide annealed under the flow of methanol vapor in nitrogen is at least 4 times as low as the electrical resistivity of the indium tin oxide annealed under the flow of nitrogen.

It will be apparent to those skilled in the art that various modifications and variations can be made in the present invention without departing from the spirit or scope of the present invention. Thus, it is intended that the present invention cover the modifications and the variations of this invention provided they come within the scope of the appended claims and their equivalents.

What is claimed is:

1. A method for preparing an indium oxide based film containing carbon, comprising the step of adding a hydrocarbon compound to the indium oxide based film during annealing of the indium oxide based film.

2. The method as claimed in claim 1, wherein the indium oxide based film is selected from the group consisting of indium oxide, indium tin oxide, and indium zinc oxide.

3. The method as claimed in claim 1, wherein the hydrocarbon compound is selected from the group consisting of methanol, ethanol, and acetone.

* * * * *